US006932684B1

(12) United States Patent
Hunt

(10) Patent No.: US 6,932,684 B1
(45) Date of Patent: Aug. 23, 2005

(54) RECIPROCAL BLADE LAPPING MACHINE

(76) Inventor: Roy H. Hunt, 2361 10th St., Rosamond, CA (US) 93560

( * ) Notice: Subject to any disclaimer, the term of this patent is extended or adjusted under 35 U.S.C. 154(b) by 23 days.

(21) Appl. No.: 10/794,653

(22) Filed: Mar. 8, 2004

(51) Int. Cl.[7] ..... B24B 7/00; B24B 9/00

(52) U.S. Cl. ..... 451/264; 451/45; 451/265; 451/367; 451/372; 451/392; 451/393; 451/443; 451/444

(58) Field of Search ..... 451/45, 264, 265, 451/367, 372, 392–393, 443–444

(56) References Cited

U.S. PATENT DOCUMENTS

| | | | | | |
|---|---|---|---|---|---|
| 2,565,590 | A | * | 8/1951 | Bullard | 451/286 |
| 2,597,187 | A | * | 5/1952 | Roshong | 451/548 |
| 2,627,144 | A | | 2/1953 | Roshong | |
| 2,779,139 | A | * | 1/1957 | Boettcher et al. | 451/286 |
| 2,782,571 | A | | 2/1957 | Hanson | |
| 2,842,906 | A | * | 7/1958 | Carter et al. | 451/364 |
| 2,945,331 | A | * | 7/1960 | La Barre et al. | 451/286 |
| 2,971,298 | A | * | 2/1961 | Garthwaite et al. | 451/286 |
| 3,004,371 | A | * | 10/1961 | Layton et al. | 451/283 |
| 3,161,996 | A | * | 12/1964 | Roshong | 451/1 |
| 3,515,115 | A | * | 6/1970 | Boettcher | 125/11.19 |
| 3,570,188 | A | * | 3/1971 | Hellmut | 451/286 |
| 4,047,640 | A | * | 9/1977 | McNamara et al. | 222/64 |
| 4,287,820 | A | * | 9/1981 | Urban | 99/538 |
| 4,363,603 | A | * | 12/1982 | Petersen | 416/244 R |
| 4,502,252 | A | | 3/1985 | Iwabuchi | |
| 4,805,348 | A | | 2/1989 | Arai et al. | |
| 4,916,868 | A | | 4/1990 | Wittstock | |
| 5,099,614 | A | | 3/1992 | Arai et al. | |
| 5,181,346 | A | * | 1/1993 | Paliwoda et al. | 451/58 |
| 5,235,785 | A | * | 8/1993 | Kurak et al. | 451/45 |
| 5,259,149 | A | * | 11/1993 | Klievoneit et al. | 451/63 |
| 5,301,473 | A | * | 4/1994 | Seear | 451/367 |
| 6,155,022 | A | * | 12/2000 | DeCanio et al. | 52/766 |
| 6,276,991 | B1 | * | 8/2001 | Kobayashi et al. | 451/28 |
| 6,511,365 | B2 | | 1/2003 | Terashima et al. | |
| 2002/0126421 | A1 | * | 9/2002 | Takahaashi et al. | 360/313 |
| 2002/0168121 | A1 | * | 11/2002 | Iida | 384/58 |

* cited by examiner

*Primary Examiner*—Joseph J. Hail, III
(74) *Attorney, Agent, or Firm*—Gordon K. Anderson

(57) ABSTRACT

A reciprocal blade lapping machine (20) is taught that is used for sharpening cutting and shearing blades. The lapping machine consists a convex lap plate (32) mounted on an enclosure (22) rotated by an electric motor (34) connected to a speed reducer (36). A lapping compound distribution system is positioned directly above the lap plate and disperses lapping compound (64) onto the convex upper surface (48) of the lap plate providing an abrasive media for removing parent material from a set of blades placed on the lap plate. A conditioning ring (66), including dead weigh within, is rotatably disposed on the lap plate impacting directly upon the rotating lap plate maintaining the convex contour. A pair of reciprocating work piece holders (74) slideably rest on the lap plate, and alternately slide work pieces (76) backward and forward in a straight line on the rotating lap plate upper surface. Matched set of work pieces (76) are retained by the work piece hold downs (98) located within the work piece holders against the convex surface of the rotating lap plate, for sharpening by honing the mating cutting faces of the work pieces.

12 Claims, 7 Drawing Sheets

RECIPROCAL BLADE LAPPING MACHINE

TECHNICAL FIELD

The present invention relates to lapping machines in general. More specifically to a blade lapping machine with work holders sliding blade sets linearly to and fro across a rotating convex lap plate.

BACKGROUND ART

Previously, many types of lapping machines have been used in endeavoring to provide an effective means to obtain a smooth lapped surface or to sharpen objects having a flat face. Many patents have been issued to special purpose lapping machines for specific purposes and to accelerate manufacturing processes.

The prior art listed below did not disclose patents that possess any of the novelty of the instant invention; however the following U.S. patents are considered related:

| U.S. Pat. No. | Inventor | Issue Date |
|---|---|---|
| 2,627,144 | Roshong | Feb. 3, 1953 |
| 2,782,571 | Hanson | Feb. 26, 1957 |
| 3,004,371 | Layton et al. | Oct. 17, 1961 |
| 4,502,252 | Iwabuchi | Mar. 5, 1985 |
| 4,805,348 | Arai et al. | Feb. 21, 1989 |
| 4,916,868 | Wittstock | Apr. 17, 1990 |
| 5,099,614 | Arai et al. | Mar. 31, 1992 |
| 6,511,365 | Terashima et al. | Jan. 28, 2003 |

Roshong in U.S. Pat. No. 2,627,144 teaches a rotating lapping plate and means for supporting work on the flat surface of the plate. A number of conditioning rings are utilized to receive the work that revolves about its own axis while the plate revolves about the vertical axis of rotation of the lapping machine.

U.S. Pat. No. 2,782,571 issued to Hanson is for a device that has a horizontal lapping plate with wear rings on the plates surface. The invention adjusts the wear effect on the rings to maintain the flat surface of the plate, edge to edge to ensure efficiency in operation.

Layton et al. in U.S. Pat. No. 3,004,371 discloses a bench type lapping machine for lapping small runs of articles. Spent grit and lapping debris is removed from the working area of the lap plate and support of the drive is furnished as an integral part of the debris container.

Iwabuchi in U.S. Pat. No. 4,502,252 teaches a lapping apparatus where washing water is ejected on wafer carriers after polishing. The polished wafers are separated from the carrier and forced above the polishing member by a pushing ring. A sweeper directs the wafers into a line and pushes them into a cassette on one side of the table where they are immersed in a pure water tank.

Wittstock in U.S. Pat. No. 4,916,868 discloses a honing, lapping and polishing machine with an outer and inner gear member and a plurality of work piece holder discs which include external teeth. A drive assembly rotates the discs by an inner gear and stops the discs in a predetermined loading and unloading position.

U.S. Pat. No. 5,099,614 of Arai et al. is for a flat lapping machine with an ultrasonic sizing mechanism for automatically lapping the work such as a semiconductor wafer and a magnetic disk substrate.

Terashima et al in U.S. Pat. No. 6,511,365 teaches a lapping machine using abrasive grains in which the abrasive grains are easily removed. A moving member with a wiping face extends in a longitudinal direction and moves in the direction perpendicular to the wiping face. The moving member catches and removes foreign substances from the lapping plate.

For background purposes and as indicative of the art to which the invention is related reference may be made to the remaining cited patent issued to Arai et al. in U.S. Pat. No. 4,805,348.

DISCLOSURE OF THE INVENTION

Lapping machines have been used for decades to obtain a very fine flat surface for items that mate together to form a seal, cutting surface, flat interface or other items requiring an extremely smooth surface. The usual purpose is to maintain an exceptionally flat face; however some mating surfaces function better if a minute or minuscule radial surface is provided. Such is the case with cutting devices that use a pair of mating blades therefore it is the primary object of the invention to obtain an extremely precise surface on the matched top (cutter) and bottom (comb) of a blade sets that function best when the convex surface of the cutter blade closely glides across the convex surface of the comb.

The present invention is best appreciated when used on the cutting surfaces of livestock clippers such as manufactured by Lister, Oster and Andis as well as human hairdressing clippers used universally in barber shops and hair dressing salons produced by Wahl, Oster and Andis etc. In order to provide this long felt need, the invention achieves the results by the use of a convex shaped lapping plate and a reciprocating work piece holder that slideably rests upon the lap plate and alternately slides the blade set backward and forward in a straight line aligned with the center of the rotating lap plate convex upper surface. Since the set is positioned side by side, the radius of the lap plate is duplicated on the cutting surfaces of the blade set as the set is continually moving across the face of the lap plate which provides accurate replication. The work piece holder not only locates and holds the blade set in place but also provides the precise amount of pressure in an adjustable and repeatable manner.

It is a common practice to sharpen clipper blades using a persons fingers to hold the blade against a moving wheel. With this manual procedure blades are easily damaged from uneven grinding, overheating and accidental mishaps. Even when damage is not apparent blade life and duration of sharpness may be considerably shortened. The invention is different from hand lapping, as uneven grinding and heating is eliminated since the lapping plate rotates slowly and the blade set is simultaneously moved by mechanical means in a linear direction across the revolving plate. Further a measured amount of fine grit mixed with oil is dripped onto the convex plate in front of the blade set being sharpened. The amount of weight pressing down on the blade set is precisely, governed by spring loading rather than by finger touch.

Another object of the invention is that the work piece holders operate in linear strokes while a conditioning ring revolves simultaneously on the rotating lap plate. The conditioning ring actually serves two purposes, first it conditions the plate by its independent rotation and second the housing may contain a separate set of blades that may be independently lapped, permitting two separate finish approaches to be accomplished with one blade lapping machine. It has been found that a single conditioning ring properly maintains the convex surface of the lap plate and is adjustable to change its position relative to the revolving center for maintaining the proper radial taper.

Still another object of the invention is that the work piece holders may be turned end for end to compensate for irregular erosion on one of the pair of wear plates that position the holder above the lapping plate, as they rest on the revolving lapping plate and may wear unevenly in time.

A further object of the invention is the addition of a multiple compound feed system verses the prior art method which feeds only a three separate streams of oil and abrasive compound onto the rotating lap plate in front of the conditioning ring and work piece holders. The multiple systems permits the stream of compound to be specifically directed to the most appropriate location based on need and is not limited to only a specific number.

A final object of the invention is directed to the improvement in the drainage of the compound from the lap plate over the prior art as a fiberglass drain pan is positioned directly under the lap plate and is configured to receive the waste compound and direct it into a container at the rear of the lapping machine by gravity. The configuration permits the entire liquid compound distributed on top of the lap plate to be received and drained since its configuration allows the pan to almost touch the bottom of the lap plate and is exposed on the periphery allowing ease of cleaning and maintenance.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
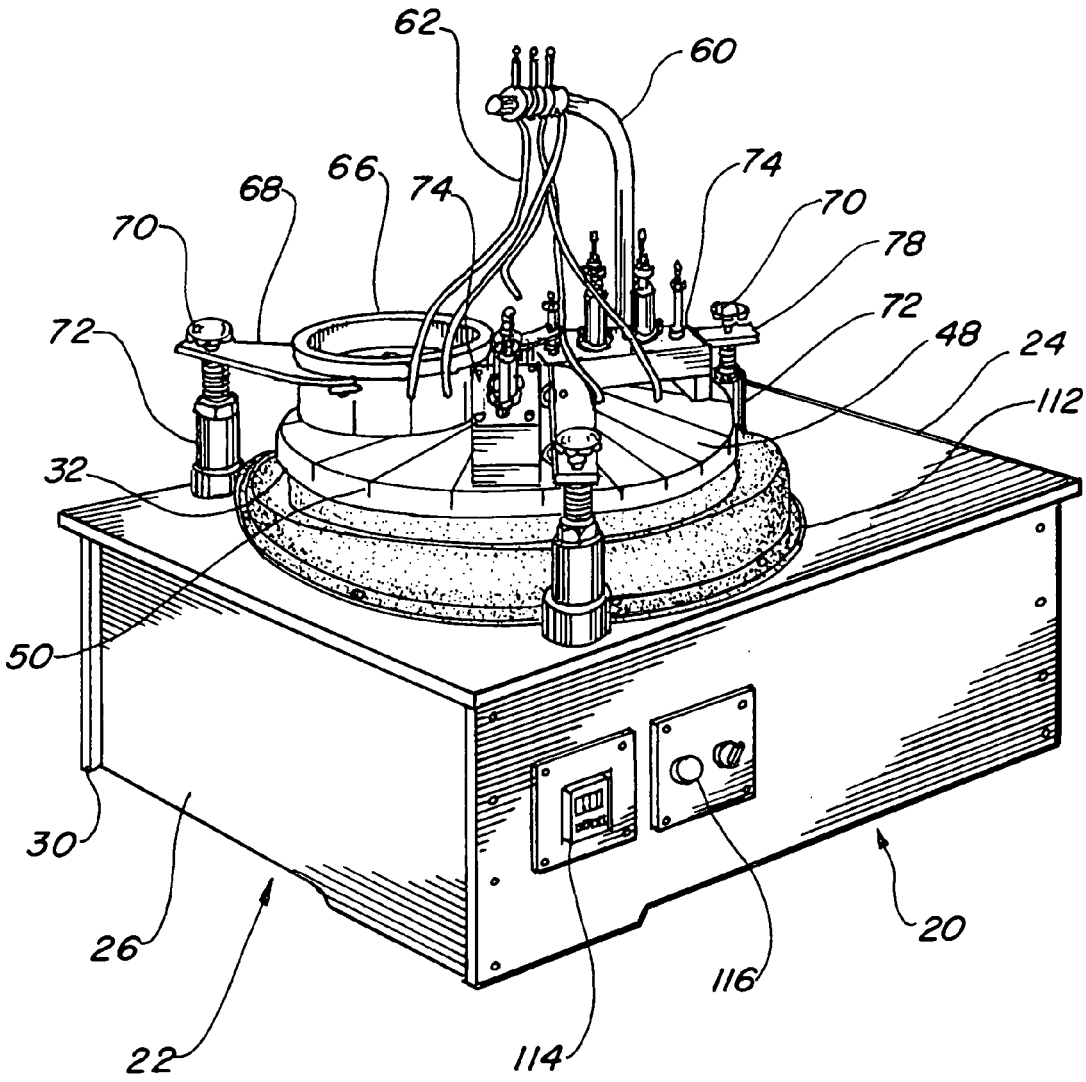
FIG. 1 is a partial isometric view of the preferred embodiment.

The best mode for carrying out the invention is presented in terms of a preferred embodiment. This preferred embodiment of the blade lapping machine 20 is shown in FIGS. 1 thorough 13 and is comprised of an enclosure 22 having a rigid top 24, sides 26 a front 28 and a back 30. The elements of the enclosure 20 are preferably a plurality of aluminum plates bolted together to form this rigid structure however any other material and type of fabrication may be equally well suited as long as it has structural integrity and is robust and rigid. It is preferred that the plates are recessed into grooves at the interfacing joints to achieve the maximum strength.

Figure 7:
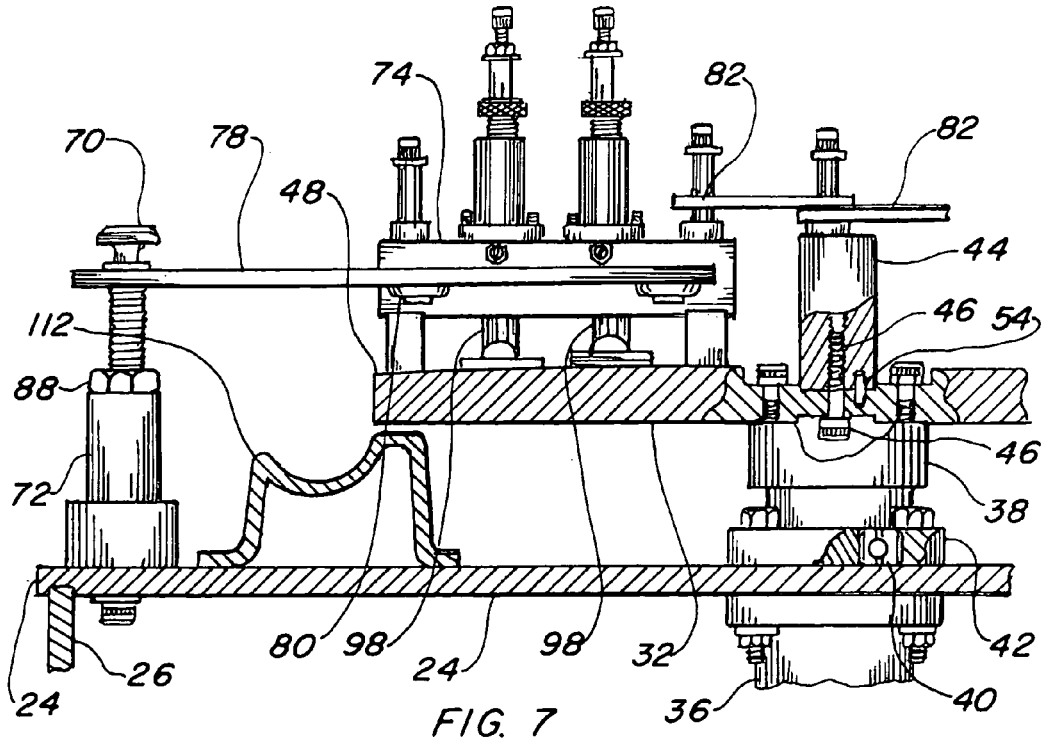
FIG. 7 is a cross sectional view taken along lines 7—7 of FIG. 6.

Drive means, as illustrated in FIG. 7, are attached to the enclosure top 24, for rotating a lap plate 32 and consist of the following; an electric motor 34, a worm gear speed reducer 36 interfacing with the electric motor 34 and a lapping plate mounting hub 38 attached to an output shaft of the speed reducer 36. A bearing 40 is attached to a bearing mounting plate 42 with the bearing 40 outer race pressed into the bearing mounting plate 42 and its inner race pressed onto a shaft of the speed reducer 36. A drive pin 44 is attached to the lap plate 32 and the lap plate 32 is attached to the mounting hub 38 with a plurality of socket head cap screws 46, as illustrated in FIG. 7. The function of the drive means is to reduce the speed of the motor 34 and transfer the rotation of the motor 34 at right angles to the lap plate 32 ultimately driving a plurality of work pieces in a linear reciprocating manner across the rotating lap plate 32.

The rotational speed of the lap plate 32 is preferably 60 revolutions per minute achieved by the use of a 30 to 1 ratio in the speed reducer 36; however other speeds may also be utilized. It will be noted that while 60 revolutions per minute is the nominal design speed for a four pole electric motor operating from a 60 hertz power source, under full load the motor turns at slightly less than the synchronous speed usually 1750 to 1725 revolutions per minute providing the lap plate 32 to rotate at closer to 58 revolutions per minute. It has been found that a ½ horsepower electric motor 34 is an optimum design to rotate a 17.50 (44.45 cm) diameter lap plate 32 with the above described speed reducer 36.

Figure 10:
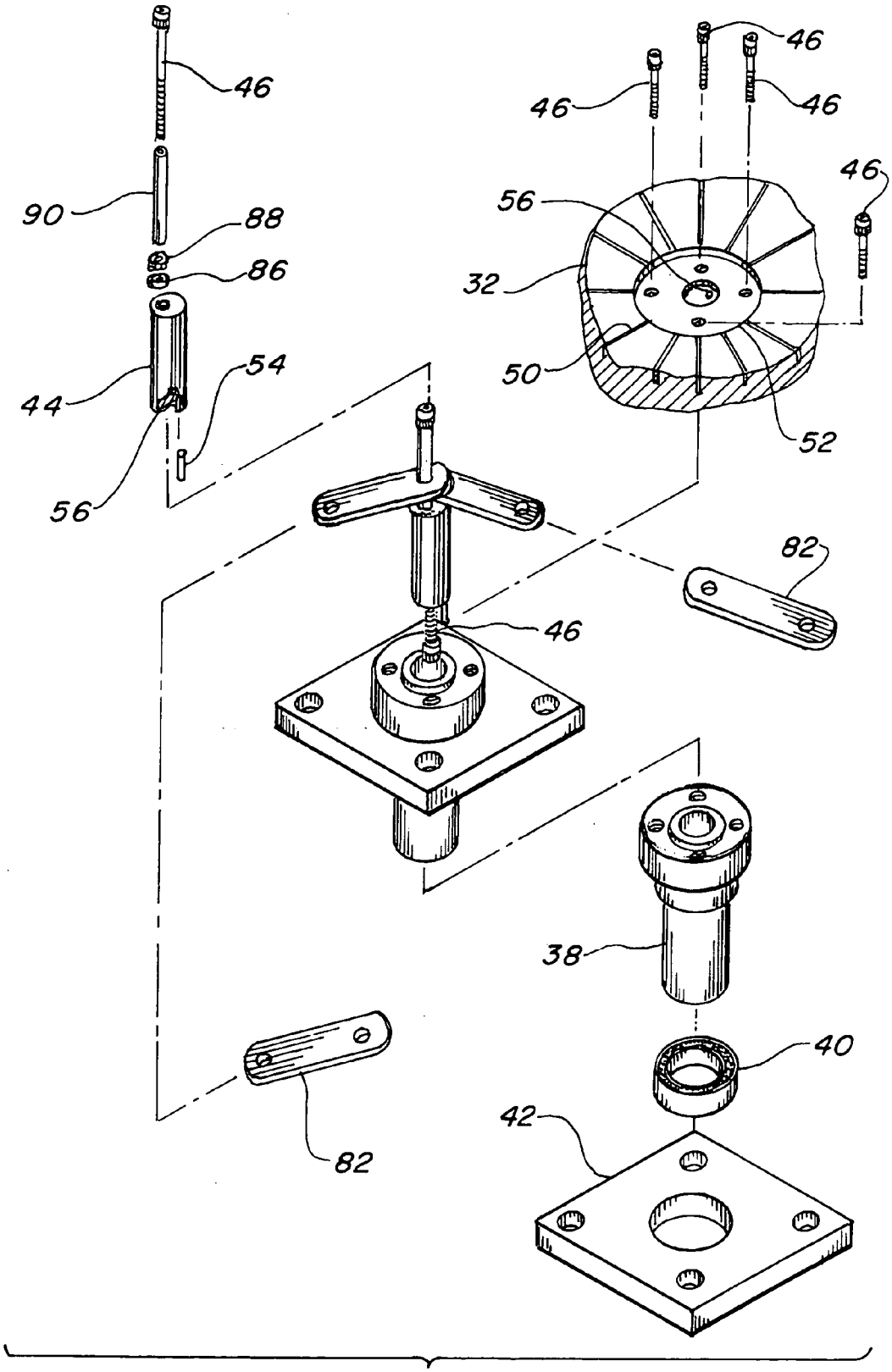
FIG. 10 is an exploded partial isometric view of part of the rotating drive means between the speed reducer and the linking pedestal including the lap plate, this assembly is illustrated removed from the invention for clarity.

The lap plate 32, mounted directly onto and rotated by the drive means, is preferably formed with a convex upper surface 48 having a radial contour at the perimeter of the surface 48 from 0.030 to 0.040 inches (0.76 to 1.016 mm) measured at a datum straight horizontal line touching the uppermost surface of the lapping plate 32. While the lapping plate 32 may be any diameter, a 17.50 inch (44.45 cm) diameter lap plate 32 has been proven to be optimum for blade sharpening. The lap plate 32 is preferably fabricated of cast iron 1.00 inch (2.54 cm) thick and incorporates a plurality of radial grooves 50 cut into the upper surface 48 at equal intervals as illustrated in FIGS. 1, 2 4–6 and 11. A counter bore 52 is cut into the center of the upper surface 48 for receiving the drive pin 44 with a socket head cap screw 46 penetrating from underneath the lap plate 32. A dowel pin 54 is positioned within mating bores 56 in the drive pin 44 and the lap plate 32 preventing rotation of the drive pin 44 within the counter bore 52, as shown in FIGS. 7 and 10.

The preferred embodiment includes a lapping compound distribution system consisting of a lapping compound pump 58, a lapping compound distribution arm 60 and a plurality of lapping compound feeds 62 positioned directly above the lap plate 32 permitting a lapping compound 64 to be dispersed onto the convex upper surface 48 of the lap plate 32. The lapping compound 64 is preferably formed of a low viscosity light oil containing granular abrasive material such as industrial diamond, silicon carbide or the like providing the necessary abrasive media within the lapping compound 64 to remove a small amount of parent material from a mating set of cutting blades. An improvement over prior art is the utilization of a multiple compound feed system that provides more than three streams of oil and abrasive compound onto the rotating lap plate 32 through a dual set of feeds 62 at the most appropriate locations on the lap plate upper surface 48. It has been found by experimentation that five feeds 62, as shown in the drawings, have proved to be most advantageous.

While any type of liquid pump may be used for the lapping compound distribution system a centrifugal sump pump is preferred such as a 1/15 horsepower 3,000 RPM unit with a self contained sump tank as illustrated in the drawings.

The invention includes at least one conditioning ring 66 rotatably disposed on the upper surface of the lap plate 32. The ring 66 is well known in the art and consists of a dead weigh disposed within, impacting directly upon said rotating lap plate surface 48. The conditioning ring 66 is made of cast iron and has a plurality of slots on a lower portion engaging the lap plate for maintaining the contour of the lap plate convex upper surface 48. An industry standard conditioning ring 66 is normally provided with the invention having a cutout phenolic work holder disposed within the ring and the work piece; usually in the form of a blade set is positioned in the cutout. While the work holder is well known in the art and available from various sources, for definition the phenolic material the work holder is made of is basically a reinforced thermoset plastic produced by combining phenol resin and formaldehyde in the presents of a catalyst with a fibrous material added to the resin for strength and impact resistance. A hold down fixture contiguously engages the blade set, with a felt pad positioned on top of the work holder and hold down fixture, further a pressure plate, that usually includes a handle, rests on top of the felt pad. The ring 66 is used in prior art for basically for honing the blade set however the main purpose in the instant invention is for maintaining the contour of the lap plate convex upper surface 48 with the secondary purpose of honing a work piece.

In order to preserve the desired contour of the convex surface 48 of the lapping plate 32, the conditioning ring 66 is normally positioned overlapping the edge which determines the contour. As an example if the ring 66 is centered on the lap plate 32 a flat surface is achieved, if the ring 66 is positioned near the center of the lap plate 32 a concave surface is formed and if the ring 66 is located away from the center, the lap plate wears into a convex surface, as desired in this invention. As previously discussed, the surface 48 of the 17.50 inch (44.45 cm) diameter lap plate 32 varies from a flat plane from 0.030 to 0.040 inches (0.76 to 1.016 mm) from a datum straight horizontal line contiguous with the uppermost surface of the lapping plate 32.

Figure 2:
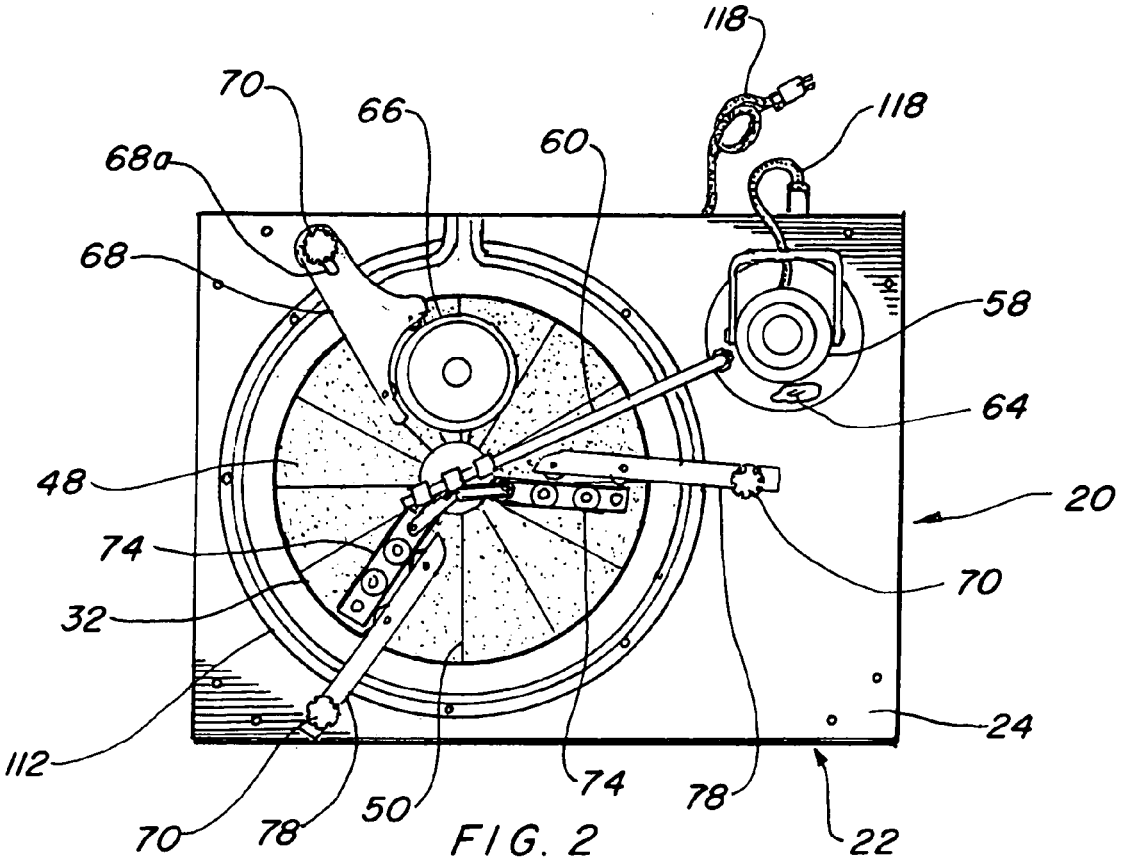
FIG. 2 is a top view of the preferred embodiment.
Figure 3:
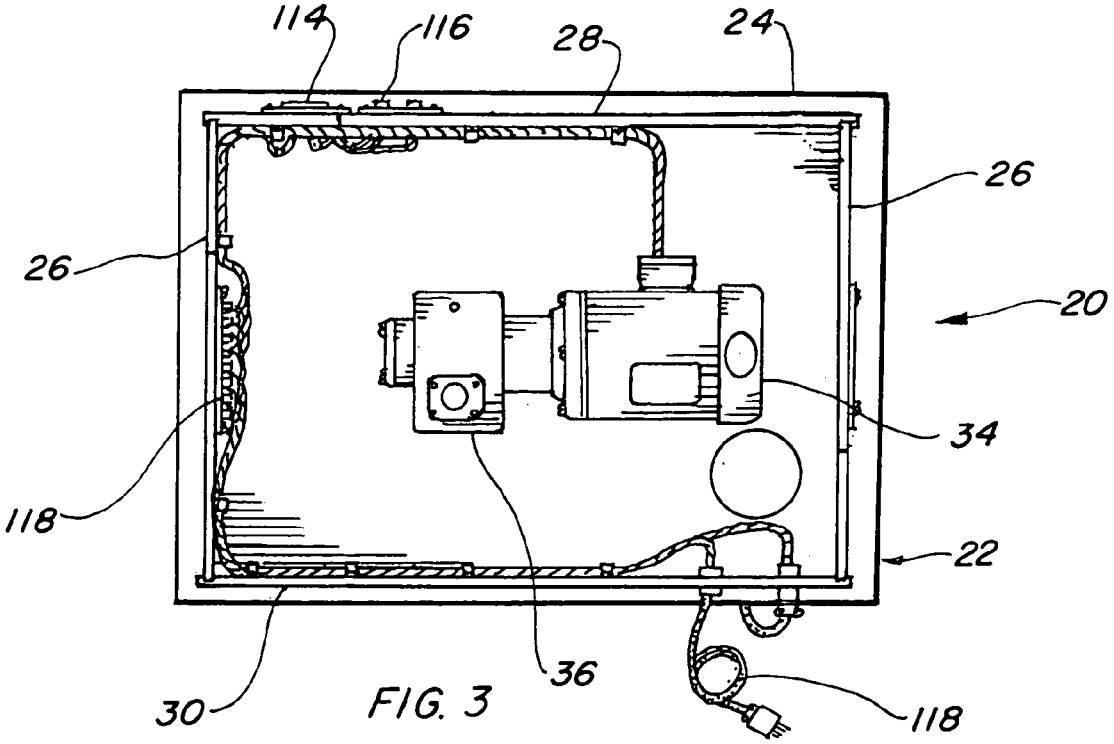
FIG. 3 is a bottom view of the preferred embodiment.
Figure 4:
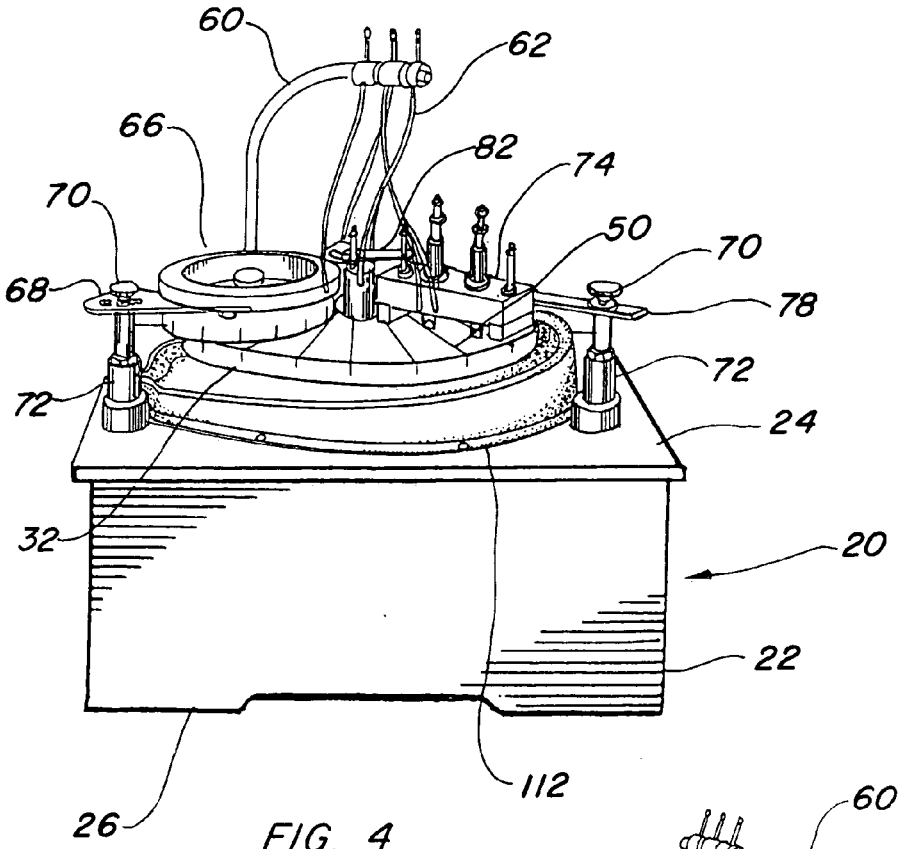
FIG. 4 is a left side perspective view of the preferred embodiment.
Figure 5:
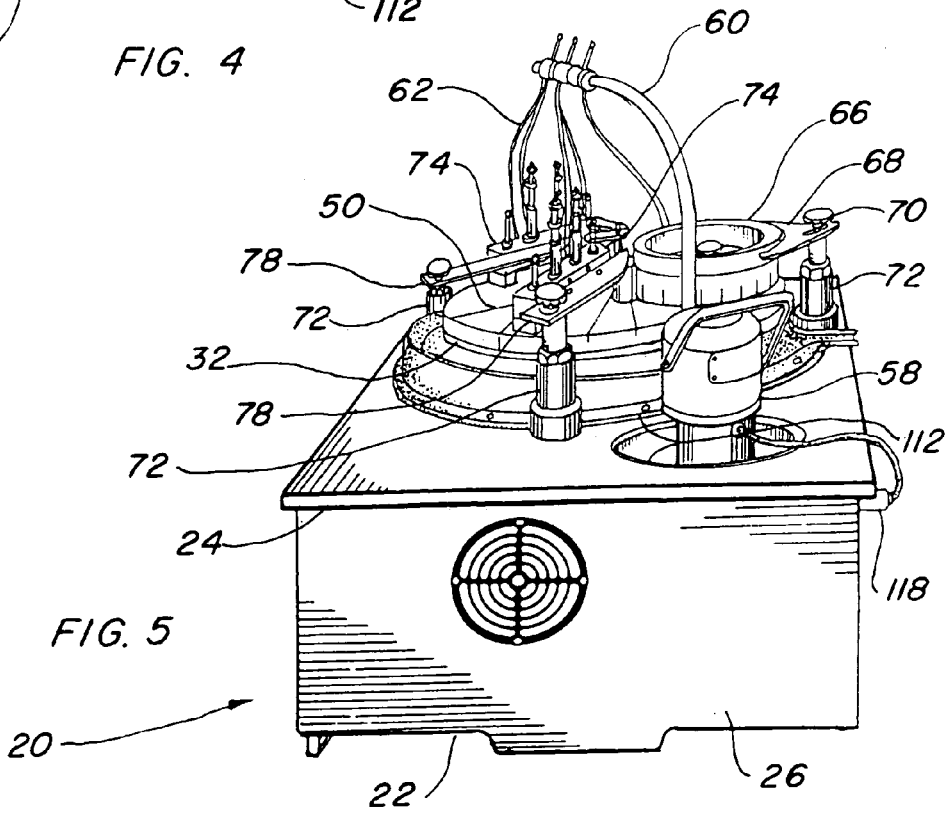
FIG. 5 is a right side perspective view of the preferred embodiment.

At any rate the maintenance on the upper lap plate surface is achieved using a conditioning ring roller arm 68 having linear adjustments in the form of a thumb screw 70 penetrating a slot 70 in the conditioning ring roller arm 68 which in turn is threadably attached to a roller arm pedestal attached to the enclosure top 24. This arrangement positions the conditioning ring 66 onto the lap plate 32 at the exact location for maintaining the contour of the lapping plate convex upper surface 48 while rotating independently on the roller arm 68. FIGS. 2 and 5 illustrate best this rotating and adjustment arrangement for the conditioning ring roller arm 68.

The invention has at least one, reciprocating work piece holder 74 slideably resting upon the rotating lap plate 32, for alternately sliding work pieces 76 backward and forward in a straight line on the rotating lap plate convex upper surface 48. While it is possible to utilize a single or even multiple work piece holders 74, two are preferred in conjunction with a 17.50 inch (44.45 cm) diameter lap plate 32 as shown. FIGS. 1, 2, 4–7 and 11 illustrate the work piece holders 74 either resting on the lap plate 32 or are shown separately in partial isometric views.

Positional work piece holder roller arms 78, having a pair of rollers 80 projecting from one side, are aligned with the work piece holders 74. The work piece holder roller arms 78 are attached to a roller arm pedestal 72 with a thumb screw 70 as shown best in FIGS. 6 and 7. The pedestal 72 is in turn connected to the enclosure top 24 permitting the work piece holders 74 to freely reciprocate in a linear fashion across the rollers 80 in the arms 78 as the arms are almost long enough to reach the center of the lap plate 32.

Figure 6:
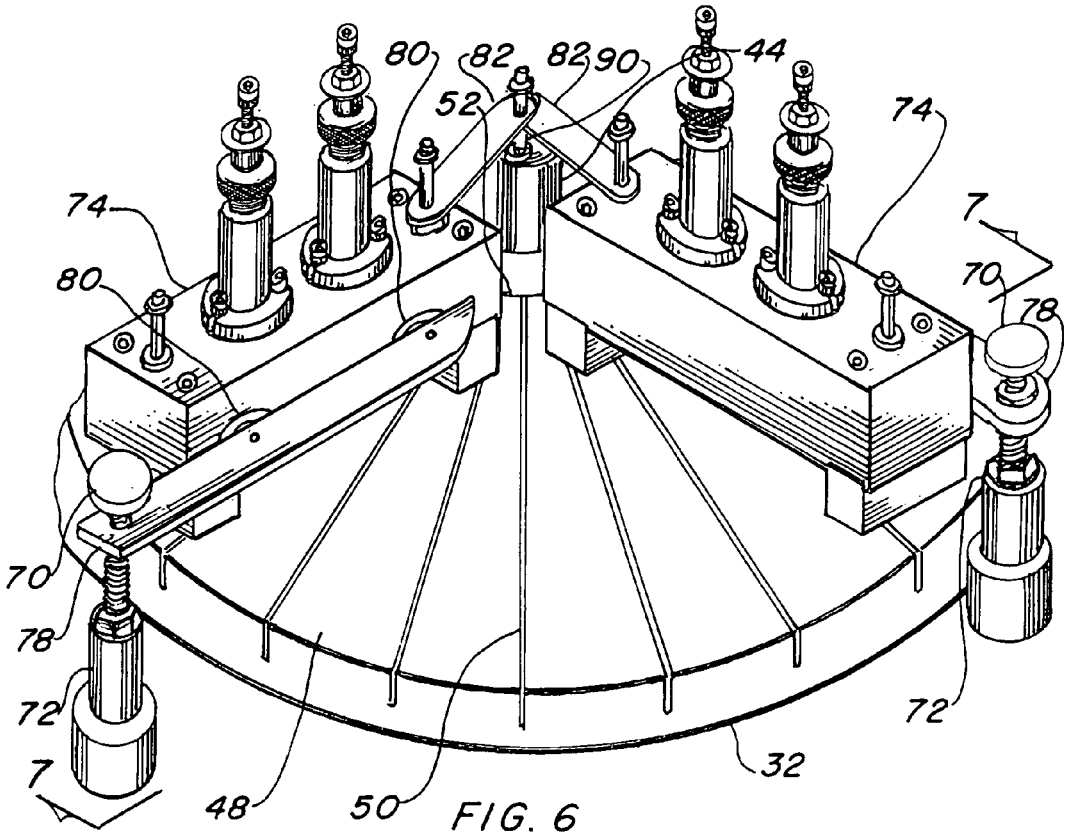
FIG. 6 is a partial isometric view of the reciprocating work piece holder arrangement of the preferred embodiment, partially removed for clarity.

Each work piece holder 74 is attached to the drive means with a cam arm 82, for reciprocation thereof. An drive pin 44 consisting of a washer 86, a hex nut 88, a hollow sleeve 90 and a socket head cap screw 46 is attached to an upper surface of the drive pin 44 offset from the center as illustrated in FIGS. 6 AND 10. The work piece holder 74 includes a linking pedestal 92 on each end of the top surface providing interface with the cam arm 82 thereby attaching each linking pedestal 92 to the drive means drive pin 44. This linking arrangement permits each work piece holder 74 to reciprocate back and forth against the rollers 80 as driven by the eccentric movement of the cam arm 82 in conjunction with the rotation of lap plate 32 holding the work piece holder 74 against the rollers 80. The length of the cam arms 82 determines the linear travel of the work piece holder 74 with the movement altered by simply substituting a different length arm 82. Two linking pedestals 92 are provided, one on each end of the work piece holder 74 for reversing ends if detrimental wear occurs.

Figure 8:
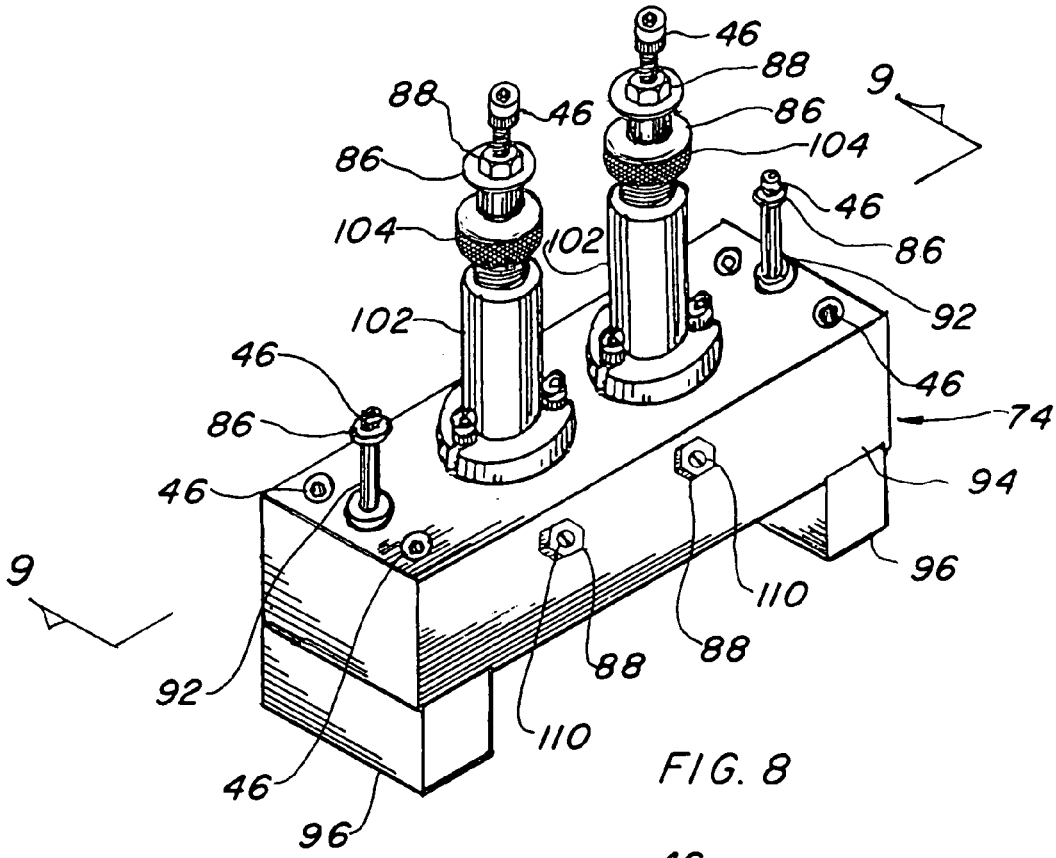
FIG. 8 is a partial isometric view of one of the work piece holders shown by itself for clarity.
Figure 9:
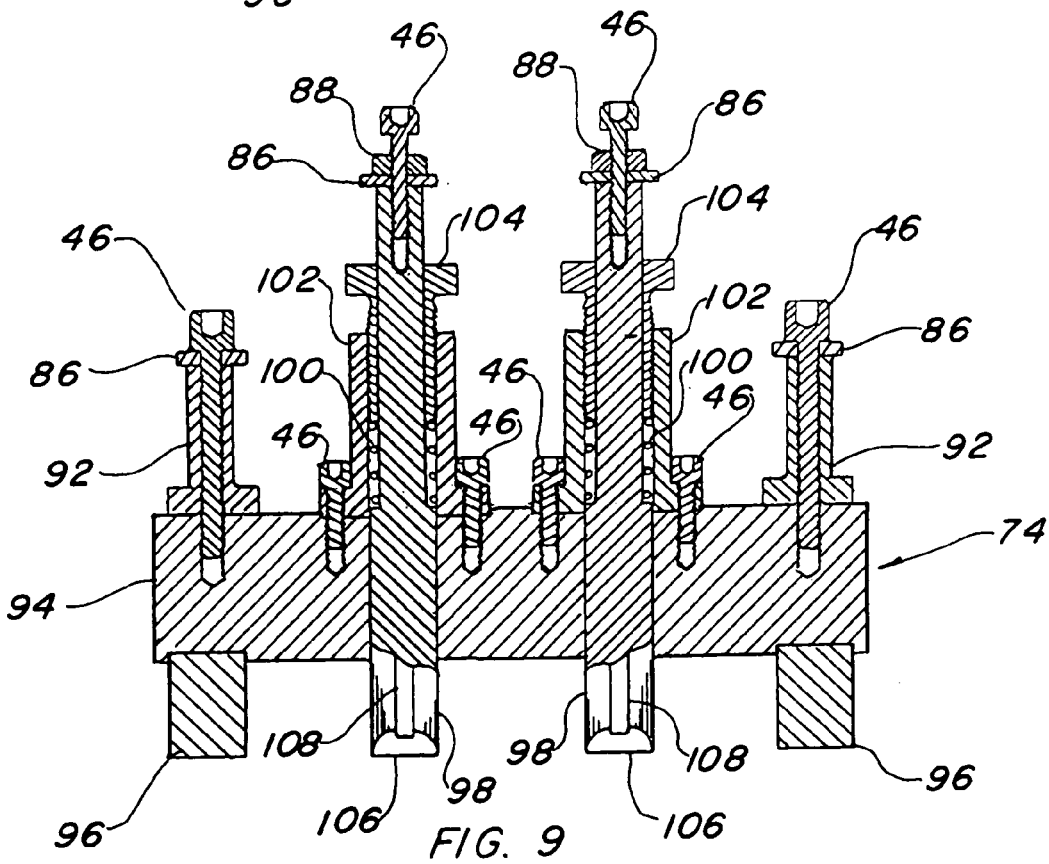
FIG. 9 is a cross sectional view taken along lines 9—9 of FIG. 8.
Figure 11:
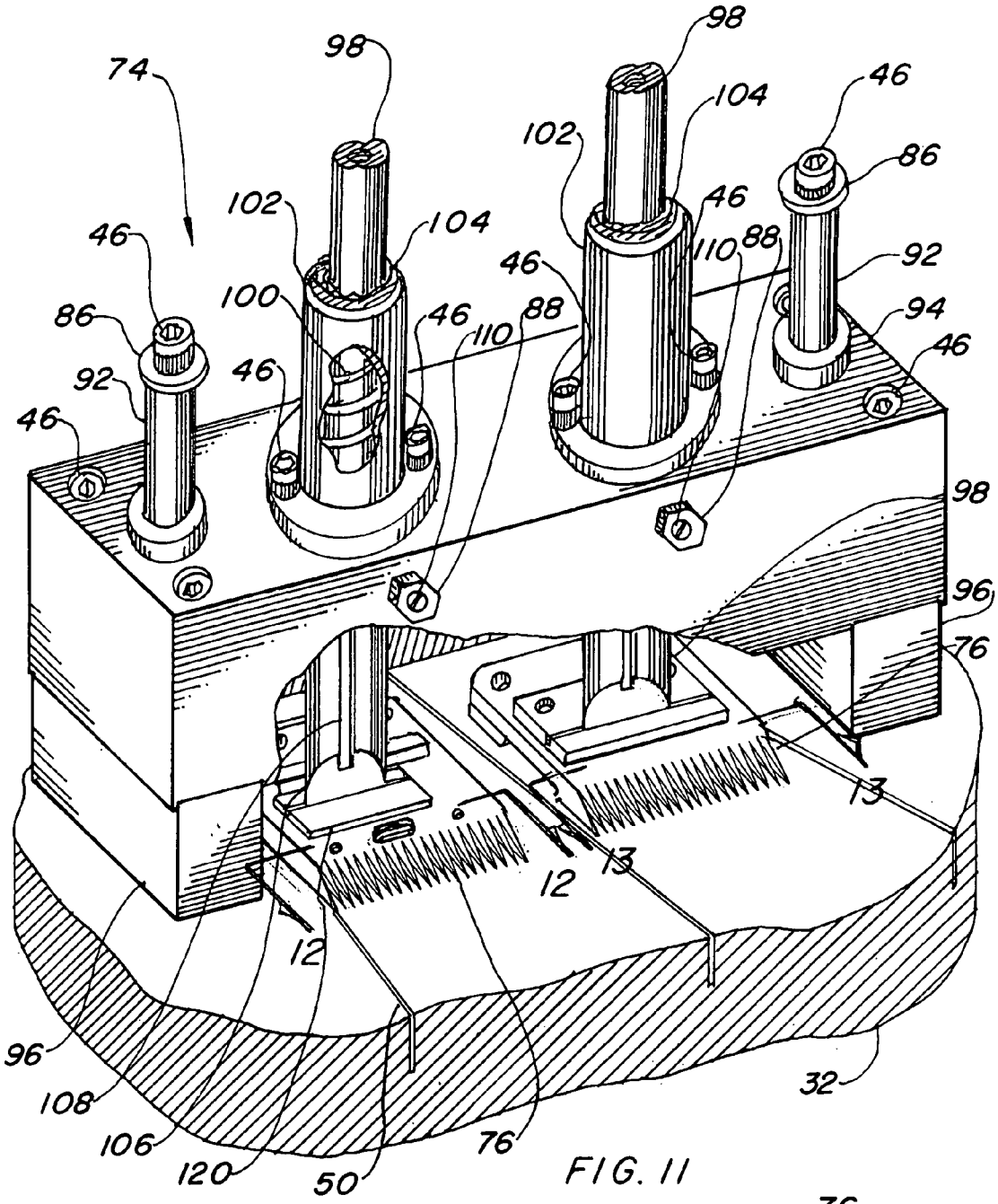
FIG. 11 is a partial isometric view of the blade set held against the lapping plate with a work piece holding fixture and the work piece hold downs removed from the invention for clarity.
Figure 12:
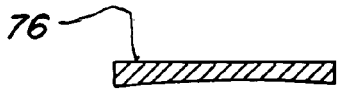
FIG. 12 is a cross sectional view taken along lines 12—12 of FIG. 11.
Figure 13:
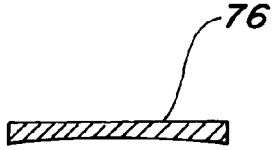
FIG. 13 is a cross sectional view taken along lines 13—13 of FIG. 11.

The work piece holder 74, as illustrated in FIGS. 8, 9 and 11, consist of a holder body 94 with a pair of wear blocks 96, fastened with socket head cap screws 46, to the outside end of each body bottom for contiguously engaging the lap plate 32. A pair of adjustable tension spring loaded work piece hold downs 98 are aligned through bores in the holder body 94 for embracing work pieces 76 against the rotating lap plate 32 with a predetermined amount of pressure created by a compression spring 100.

Each work piece hold down 98 is held in alignment by an internally threaded holder flanged sleeve 102 attached to the top of the body 94 over the bores with a pair of socket head cap screws 46, as illustrated in the above mentioned drawings. Adjustment of the work piece hold down 98 is provided by a threaded sleeve spring tension adjuster 104 having a knurled flange on the top for manual rotation when the spring tension adjuster 104 is threaded into the holder flanged sleeve 102 until it engages the compression spring 100 causing the exact amount of pressure to the work piece hold down 98. A washer 86, hex nut 88 and socket head cap screw 46 threaded into the top of the work piece hold down 98 limits the travel assuring the adjustment. The work piece hold down 98 has a chisel shaped end 106 and a keyway 108 that interfaces with a dog point screw 110 and hex nut 88 assuring that the chisel point retains its proper alignment.

To complete the invention and provide improved functional operation a fiberglass drain pan 112 is provided, configured to mount between the lap plate 32 and the rigid top 24 of the enclosure 22 for collecting the lapping compound 64 from the distribution system and directing the liquid compound 64 to a convenient location at the rear of the enclosure 22. An electrical system is also included to power the electric motor 34 and pump 58 which includes a timer 114, switches 116 and the necessary interconnecting wiring 118.

In operation a matched set of work pieces 76 are retained by the work piece hold downs 98 against the convex surface of said rotating lap plate 32 for sharpening by honing the mating cutting faces of the work pieces 76. As each pair of work pieces 76 may differ in their configuration, depending upon their manufacture, it may be necessary to provide at least one work piece holding fixture 120 to provide an accessible attaching surface for the work piece hold down 98.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A reciprocal blade lapping machine for sharpening cutting and shearing blades comprising, an enclosure having a rigid top and sides with drive means contained within the enclosure attached to the enclosure top, a cam arm attached to said drive means for reciprocation thereof, a lap plate having a convex upper surface mounted directly onto and rotated by said drive means, a lapping compound distribution system having feeds positioned directly above the lap plate such that lapping compound is dispersed onto the convex upper surface of the lap plate providing an abrasive media for removing parent material from a set of blades, at least one conditioning ring rotatably disposed on said lap plate, said ring having a dead weigh disposed within, impacting directly upon said rotating lap plate surface, at least one reciprocating work piece holder slideably resting upon said rotating lap plate, for alternately sliding work pieces backward and forward in a straight line on said rotating lap plate convex upper surface, wherein said work piece holder further comprising a linking pedestal on each end with said cam arm attached to one linking pedestal, permitting reversing ends when detrimental wear occurs, and a matched set of work pieces retained by the work piece holder against the convex surface of said rotating lap plate for sharpening by honing the mating cutting faces of the work pieces.

2. The reciprocal blade lapping machine as recited in claim 1 wherein said enclosure is fabricated of a plurality of aluminum plates bolted together.

3. The reciprocal blade lapping machine as recited in claim 1 wherein said lapping plate has a radial convex surface contour relative to the outside diameter of the lapping plate of from 0.030 to 0.040 inches (0.76 to 1.016 mm) from a datum straight horizontal line touching the uppermost surface of the lapping plate.

4. The reciprocal blade lapping machine as recited in claim 1 wherein said lapping compound distribution system further comprises a multiple compound feed system providing more than three streams of lapping compound in the form of oil and abrasive particles onto the rotating lap plate in front of the conditioning ring and work piece holder.

5. The reciprocal blade lapping machine as recited in claim 1 wherein said conditioning ring is made of cast iron and said conditioning ring having a plurality of slots on a lower portion engaging said lap plate for maintaining the contour of the lap plate convex upper surface.

6. The reciprocal blade lapping machine as recited in claim 5 wherein said cast iron conditioning ring further comprises a phenolic work holder, having a cutout therein, disposed within the ring with a work piece blade set positioned within said cutout, a hold down fixture contiguously engaging said blade set, a felt pad positioned on top of the work holder and hold down fixture, and a pressure plate having a handle resting on top of the felt pad, for honing the work piece blade set and also maintaining the contour of the lap plate convex upper surface.

7. The reciprocal blade lapping machine as recited in claim 1 further comprising an adjustable location conditioning ring roller arm, attached to said enclosure top for positioning the conditioning ring onto the lap plate at an appropriate location for maintaining the contour of the lapping plate convex upper surface while rotating independently on the roller arm.

8. The reciprocal blade lapping machine as recited in claim 1 further comprising a positional work piece holder roller arm having a pair of rollers projecting from one side, in alignment with said work piece holder and attached to said enclosure rigid top for embracing said work piece holder permitting the holder to reciprocate in a linear fashion across the arm while contiguously engaging said rollers.

9. The reciprocal blade lapping machine as recited in claim 1 wherein said work piece holder further comprises a holder body having a pair of wear blocks contiguously engaging said lap plate, a pair of adjustable tension spring loaded work piece hold downs aligned through said holder body for embracing work pieces against the rotating lap plate with a predetermined amount of pressure.

10. The reciprocal blade lapping machine as recited in claim 1 further comprising at least one work piece holding fixture configured to retain said matched set of work pieces and provide an accessible attaching surface for said work piece holder.

11. The reciprocal blade lapping machine as recited in claim 1 further comprising a fiberglass drain pan configured to mount between said lapping plate and said rigid top the enclosure for collecting lapping compound from the distribution system and directing to a convenient location at the enclosure rear.

12. A reciprocal blade lapping machine for sharpening cutting and shearing blades comprising, an enclosure having a rigid top and sides with drive means contained within the enclosure attached to the enclosure top, wherein said drive means drive means further comprising, an electric motor, a worm gear speed reducer interfacing with the electric motor, a lapping plate mounting hub attached to the speed reducer, a bearing pressed into a mounting plate with the bearing interfacing with the speed reducer and a drive pin attached through the lap plate to the mounting hub, reducing the speed of the motor and transferring the rotation at right angles to the lap plate and also driving the work piece holder in a linear reciprocating manner, a lap plate having a convex upper surface mounted directly onto and rotated by said drive means, a lapping compound distribution system having feeds positioned directly above the lap plate such that lapping compound is dispersed onto the convex upper surface of the lap plate providing an abrasive media for removing parent material from a set of blades, at least one conditioning ng rotatable disposed on said lap plate, said ring having a dead weigh disposed within, impacting directly upon said rotating lap plate surface, at least one reciprocating work piece holder slideably resting upon said rotating lap plate, for alternately sliding work pieces backward and forward in a straight line on said rotating lap plate convex upper surface, and a matched set of work pieces retained by the work piece holder against the convex surface of said rotating lap plate for sharpening by honing the mating cutting faces of the work pieces.

* * * * *